United States Patent [19]

Kondo

[11] 4,434,340

[45] Feb. 28, 1984

[54] SWITCH OPERATING MECHANISM

[75] Inventor: Masao Kondo, Hamamatsu, Japan

[73] Assignee: Nippon Gakki Seizo Kabushki Kaisha, Shizuoka, Japan

[21] Appl. No.: 288,194

[22] Filed: Jul. 29, 1981

[30] Foreign Application Priority Data

Aug. 13, 1980 [JP] Japan ..... 55-113765[U]

[51] Int. Cl.[3] ..... H01H 3/04

[52] U.S. Cl. ..... 200/332; 200/339; 200/330; 84/435

[58] Field of Search ..... 200/329, 330, 331, 337, 200/338, 340, 339, 5 A, 332; 84/433, 434, 435, DIG. 7

[56] References Cited

U.S. PATENT DOCUMENTS

| | | | |
|---|---|---|---|
| 206,345 | 7/1878 | Milliken | 84/433 |
| 932,705 | 8/1909 | Hosley | 84/434 |
| 3,800,104 | 3/1974 | Lien et al. | 200/159 A X |
| 3,855,894 | 12/1974 | Thomas et al. | 84/433 X |
| 3,941,953 | 3/1976 | Misson et al. | 200/340 X |
| 4,019,418 | 4/1977 | Kimble et al. | 200/339 X |

FOREIGN PATENT DOCUMENTS

| | | | |
|---|---|---|---|
| 1665094 | 12/1970 | Fed. Rep. of Germany | 200/330 |

*Primary Examiner*—John W. Shepperd
*Assistant Examiner*—Renee S. Kidorf
*Attorney, Agent, or Firm*—Blakely, Sokoloff, Taylor & Zafman

[57] ABSTRACT

A switch operating member for actuating a switch is pivotably accommodated in an opening of a base plate. A bearing member is secured to a rear surface of the base plate near the opening and overlying the same. The operating member is provided with U shaped supporting members on both sides to pivotally mount the operating member on a shaft in cooperation with the bearing member.

13 Claims, 13 Drawing Figures

SWITCH OPERATING MECHANISM

BACKGROUND OF THE SPECIFICATION

This invention relates to a switch operating mechanism and more particularly an operating mechanism for actuating a switch of the type directly incorporated into a panel or a base plate.

Generally, in such electronic musical instrument as an electronic organ, such various control switches as a power switch, a tone color preset switch, an autorythm switch, a sustain switch or the like are disposed beneath a control panel and ON/OFF-controlled by operating members mounted on the panel.

FIG. 1 illustrates one example of a prior art switch operating mechanism of the type described above. As shown, switch operating members 3 are rotatably mounted with a pivot shaft 4 inserted and received in openings 2 respectively. When the operating members 3 are depressed, touch switches 6, for example, disposed beneath the operating panel 1 are operated through actuators 5. The two ends of the pivot shaft 4 are secured to the rear surface of the operating panel 1 through fittings 7.

In the prior art switch operating mechanism described above, however, as it is necessary to insert the shaft 4 through the shaft openings 8 of the operating members 3 and to secure the fittings 7 to the rear surface of the operating panel 1 with set screws 9, not only the assembling and disassembling operations are troublesome, but also the number of the component parts increases.

SUMMARY OF THE INVENTION

Accordingly, it is an object of this invention to provide an improved switch operating mechanism having a simple construction and requiring a small number of component parts.

Another object of this invention is to provide a switch operating mechanism especially suitable for mounting side by side a plurality of switches on a base plate.

A further object of this invention is to provide an improved switch operating mechanism capable of readily and rapidly mounting component parts on the base plate.

According to this invention there is provided a switch operating mechanism of the type wherein at least one switch is mounted on a base plate, the base plate is provided with at least one opening for accommodating an operating member for actuating the switch, and one end of the operating member is pivotally supported, characterized in that there are provided a bearing member projecting from a portion of the rear surface of the base plate near the opening and overlying the same, a pair of supporting members projecting in opposite directions from the operating member, the distance between the outer sides of the supporting members being larger than the width of the opening, an engaging member located near the opening for rotatably engaging said bearing member when the operating member is mounted, and an actuator operated by the operating member for actuating the switch.

DESCRIPTION OF THE PREFERRED EMBODIMENTS

Figure 1:
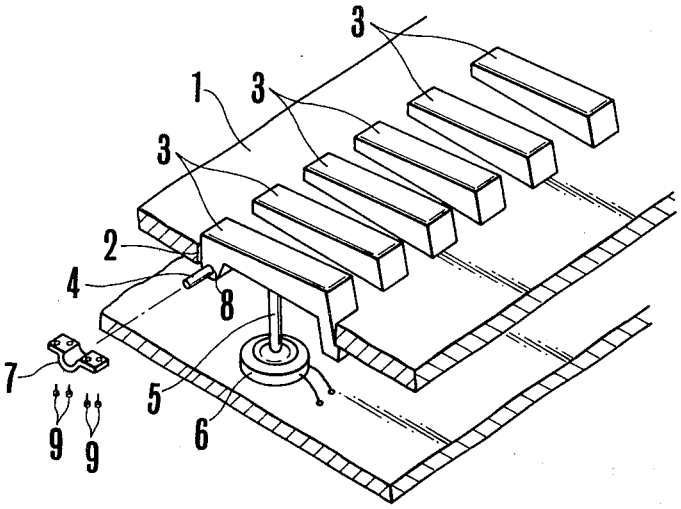
FIG. 1 is a perspective view, partly in section, showing one example of a prior art switch operating mechanism.
Figure 2:
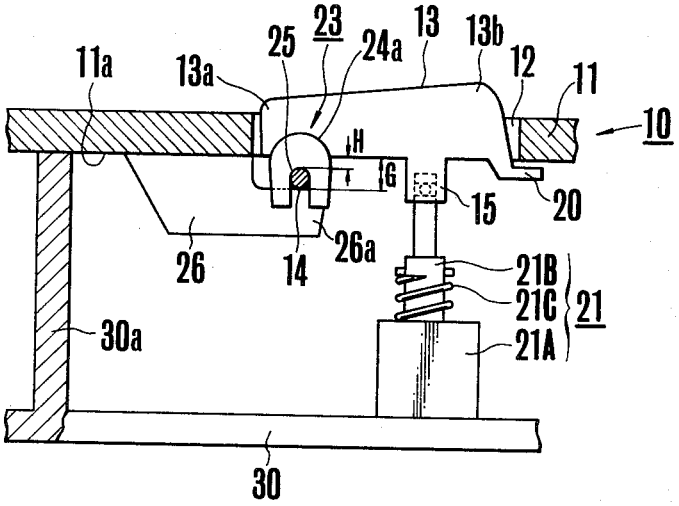
FIG. 2 is a side view, partly in section, showing one embodiment of the switch operating mechanism according to this invention.
Figure 3:
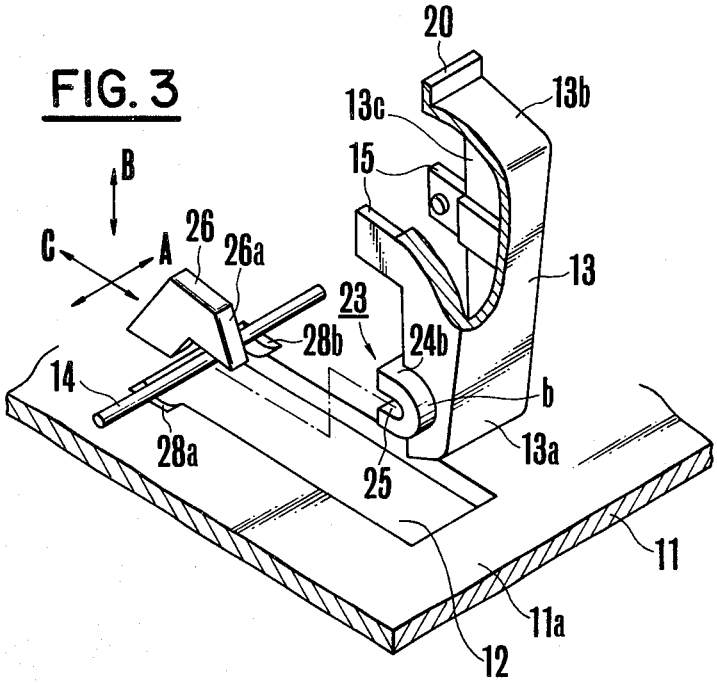
FIG. 3 is a perspective bottom view, partly exploded, of the switch operating mechanism shown in FIG. 2.

A preferred embodiment of this invention is illustrated in FIGS. 2 and 3 in which a plurality of operating members 13 (only one of them is shown) are freely inserted in rectangular openings 12 provided at prescribed positions of an operating panel or base plate 11 of a switch structure 10 with their upper portions projected upwardly. Each operating member 13 is made of a synthetic resin and its rear end 13*a* is pivotably supported by a shaft 14, while a stop member 20 is formed on the lower surface of the front end 13*b* for preventing the operating member 13 from disengaging from the opening 12. Each operating member 13 is shaped as a trough 13*c* having a rectangular cross-section and a groove extending in the longitudinal direction thereof. A pair of actuators 15 are formed on both side walls of the trough 13*c* at about the longitudinal center thereof so as to actuate a push button switch 21 to be described hereinafter. At the rear end 13*a* of the trough shaped operating member 13 is integrally formed a rotary or pivot support 23 comprising a pair of inverted U shaped or semicircular projections 24*a* and 24*b* projecting from both side walls. The rotary support 23 is further provided with grooves 25 for receiving the shaft 14.

On the bottom surface 11*a* of the operating panel 11 and on the center line of the openings 12 for accommodating the operating member 13 is formed a bearing means or a shaft support 26 integrally with the panel 11 near the rear ends of the openings 12. The fore end 26*a* of the shaft support 26 is spaced from the bottom surface 11*a* of the panel 11 by a suitable distance G and lies above the rear portion of the opening 12 so as to support an intermediate portion of the shaft 14 on the upper surface of the fore end 26*a*. Semicircular notches 28*a* and 28*b* are provided for the rear surface 11*a* of the panel 11 on both sides of the rear end of each opening 12 for rotably receiving upper curved portions b or the pair of projections 24*a* and 24*b* comprising the rotary support 23.

The operating members 13 are mounted on the shaft 14 from the side of the bottom surface 11*a* of the operating panel 11. More particularly, as shown in FIG. 3, the shaft 14 is inserted into the gap G between the bottom surface 11*a* of the panel 11 and the fore end 26*a* of the shaft support 26 from the lefthand side as viewed in FIG. 3. The gap G is sized such that after the shaft 14 is inserted into the gap, the shaft is clamped between bottom surface 11*a* and fore end 26*a*. Then the grooves 25 of the pairs of projections 24*a* and 24*b* of the operating members 13 are fitted to the shaft 14 from the bottom surface 11*a* the operating panel 11. According to another method, after prefitting the shaft 14 into the grooves 25 of the operating member 13, the shaft 14 is inserted into the gaps G. Thereafter the operating members 13 are rotated about the shaft 14 in the counter clockwise direction as viewed in FIG. 2 to cause the fore ends 13*b* to project above the openings 12. At this time, the upper curved portions b of the projections 24*a* and 24*b* would be received in the notches 28*a* and 28*b* on both sides of the rear end of each opening 12 so as to support the shaft 14 at three points by the pair of grooves 25 and the fore end 26*a* of the shaft support 26. Then, the rear end 13*a* of each operating member 13 is prevented from moving in the left and right direction and fore and aft directions (in the directions of A and C shown in FIG. 3) by the engagement of the projections 24*a* and 24*b* with the notches 28*a* and 28*b*, whereas in the vertical direction by the shaft 14, thereby preventing the rear end 13*a* of each operating member 13 from disengaging the opening 12. Disengagement of the fore end 13*b* of each operating member 13 from the opening 12 is prevented by a stop member 20.

A switch mounting member 30 is secured to the base plate 11 with a suitable supporting member 30*a* at a suitable distance from the bottom surface 11*a* of the operating panel 11, and well known push button switches 21 are mounted on the upper surface of a switch mounting member 30 to confront respective actuators 15 of the operating members 13. Each push button switch 21 comprises a switch 21A, an actuating rod 21B free to move in the vertical direction, and a return spring 21C normally pusing the actuating rod upward towards the actuator.

When the operating member 13 is depressed by an operator, the actuator 15 moves downwardly so that the actuating rod 21B would be locked in the depressed state to close the switch 21A. Thereafter, when the operating member 13 is depressed again, the actuating rod 21B is released and returned to the original position by the return spring 21C thus opening the switch 21A.

As above described, according to this invention, a rotary support 23 constituted by a pair of U shaped projections forming grooves 25 which face downward are integrally provided on both sides of the lower surface of an operating member 13. A shaft 14 secured to the rear surface 11*a* of an operating panel 11 is fitted into the grooves 25 so that it is possible to mount the operating member 13 with a single operation, thus simplifying the assembling operation. Moreover, as portions of the rotary supports 23 are projected in the lateral direction of the operating member 13, and the projected portions 23 are fitted in the notches or recesses 28*a*, 28*b* provided for the operating panel 11, it is possible to prevent disengaging and the lateral movement of the operating member 13, thus enabling stable operation of the switch 21. Further, shaft supports 26 are integrally provided for the rear surface 11*a* of the operating panel 11 with their fore ends 26*a* overlapped with the openings 12 for accommodating the operating members 13 to hold the shaft 14 between the fore ends 26*a* and the rear surface 11*a* of the panel 11 so that it is possible to readily mount the shaft 14 on the operating panel 11.

Figure 4:
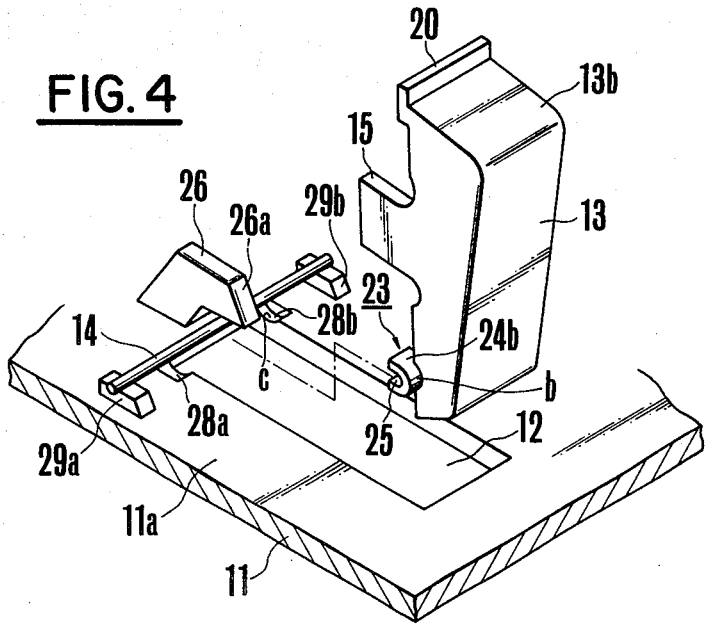
FIG. 4 is a perspective bottom view showing a modification of the operating mechanism embodying the invention.

Although in the above described embodiment, the shaft 14 is supported at three points by the pair of grooves 25 and the fore end 26*a* of the shaft support 26 so as to maintain a suitable distance H (see FIG. 2) with respect to the rear surface 11*a* of the operating panel 11, the shaft 14 may be supported at three points with the fore end 26*a* of the shaft support 26 and a pair of projections 29*a* and 29*b* integrally formed on the rear surface 11*a* of the operating panel 11 as shown in FIG. 4. In this case, the shaft 14 is pushed into the gap G defined between the rear surface 11*a* of the operating panel 11 and the fore end 26*a* of the shaft support 26 by slightly elastically deforming these elements for mounting the shaft 14 on the operating panel 11 with the central portion of the shaft 14 supported by the fore end 26*a* and with the both ends abutted against the lower surfaces of the shaft holding projections 29*a* and 29*b*. In this embodiment, the upper curved portions b at the upper portions of a pair of projections 24*a* and 24*b* of each operating member 13 are received in the notches 28*a* and 28*b* in the same manner as in the previous embodiment.

Figure 5:
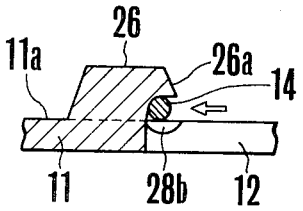
FIG. 5 is a side view, partly in section, showing a modified shaft support.

As shown in FIG. 5, where the width of the gap G is decreased by the height of the projections 29*a* and 29*b* so as to elevate the fore end 26*a* it is possible to directly support the both ends of the shaft 14 with the bottom surface 11*a* of the operating panel 11 without using the projections 29*a* and 29*b* shown in FIG. 4.

Thus, with the switch operating mechanism embodying the invention, it is possible to readily mount the shaft 14 on the panel 11 independently of the operating members 13 instead of establishing an opening in the operating member, passing the shaft through the opening or removing a fixture for the shaft. This not only reduces the number of assembly steps and the component parts but also facilitates disassembling at the time of inspection and repair. Moreover, as the operating members 13 are prevented from disengaging and moving laterally, it is possible to stably depress the operating members, in other words, the switches can be operated positively. Moreover, as it is possible to make uniform the gap width between each operating member 13 and an opening 12 for accommodating the same, the appearance of the panel surface can be improved. Moreover, as the shaft 14 is secured by a pair of grooves 25 formed by the rotary supports 23. The shaft 14 is further secured by the fore end 26*a* of the shaft 26.

Figure 6A:
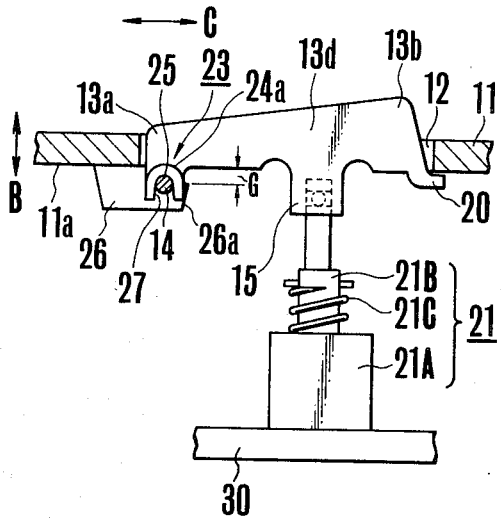
FIG. 6*a* is a side view, partly in section, showing still another embodiment of this invention.
Figure 6B:
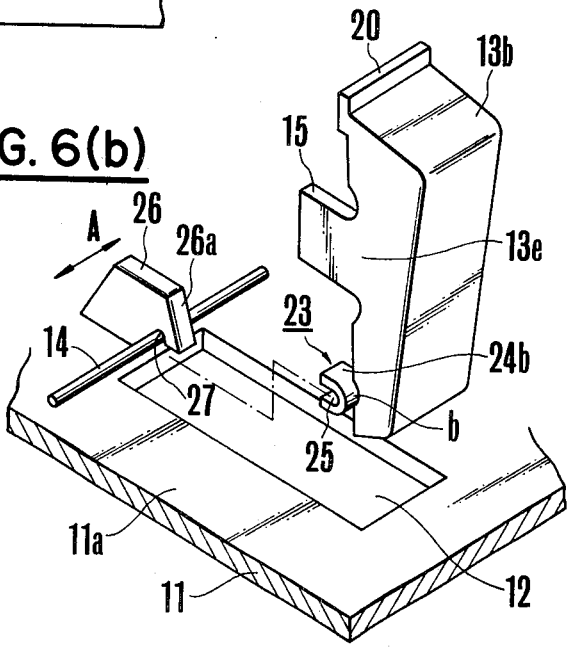
FIG. 6*b* is a perspective bottom view showing a state before mounting an operating member on the panel.

FIGS. 6*a* and 6*b* show still another modification which is different from the foregoing embodiments in that the fore end 26*a* of the shaft support 26 is provided with a bearing 27 in the form of a circular arc or a U shaped groove. Other parts are identical to those of the foregoing embodiments so that they are designated by the same reference charactors to omit their description. With this modified embodiment, since the shaft 14 is fitted into the bearing 27, the fore and aft movement (in the direction of arrow C shown in FIG. 6*a*) is prevented, shaft 14 can be maintained in position. This construction can eliminate the notches 28*a* and 28*b* on the rear surface 11*a* of the operating panel 11 thus simplifying the construction. Thus, the movement of the rear end 13*a* of the operating member 13 in the vertical direction (that is in the direction shown by an arrow B in FIG. 6*a*) is limited by the engagement of the upper curved portions b of a pair of projections 24*a* and 24*b* against the rear surface 11*a* of the operating panel 11, while the movement of the operating member 13 in the left and right direction (in the direction shown by an arrow A in FIG. 6*b*) is prevented by the engagement of the side walls 13*d* and 13*e* of the operating member 13 against the side walls of the opening 12, thus preventing the rear end 13*a* of the operating member 13 from disengaging from the opening 12.

Figure 7:
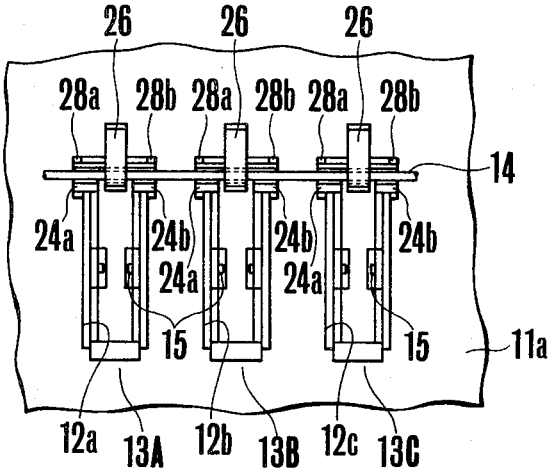
FIG. 7 is a plan view showing another modification in which a plurality of operating members are mounted on a single shaft.

Although the foregoing embodiments have been described mainly with reference to a single operating member, as shown in FIG. 7, a plurality of operating members 13A, 13B, 13C . . . may be supported by a single shaft 14. In this case too, shaft supports 26 as shown in FIG. 2 are provided for the operating panel 11 respectively corresponding to the openings 12*a*, 12*b* and 12*c* for accommodating the operating members 13. Other component elements, and the method of mounting the shaft 14, and the operating members 13A, 13B, 13C . . . are identical to those described above.

Figure 8:
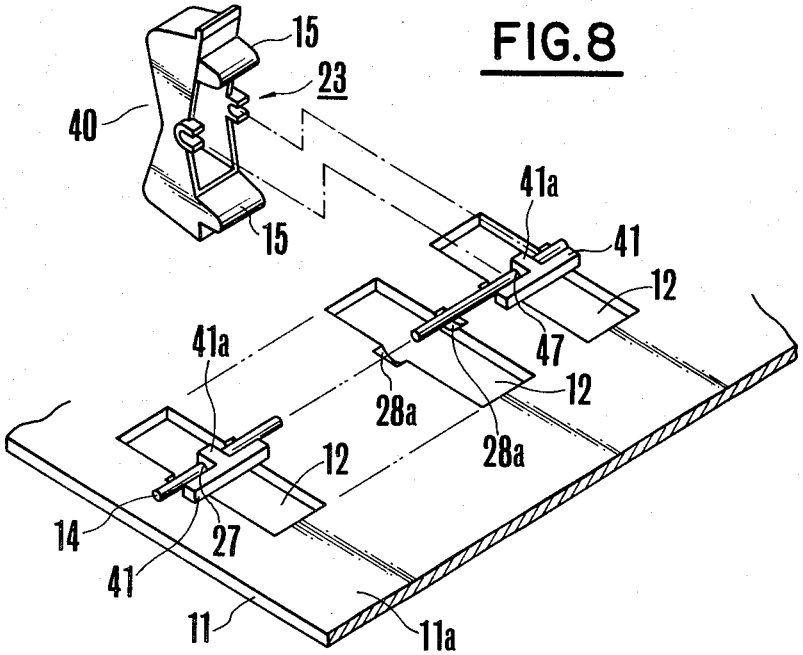
FIG. 8 is a perspective view showing a seesaw switch operated by an operating member.

Although the foregoing embodiments were described with reference to operating members for ON/OFF-controlling push button switches 21, it should be understood that the invention is not limited to this particular construction. For example, as shown in FIG. 8, an operating element may be used to actuate a two contact driving type seesaw switch. In this case, rotary supports 23 are formed at about the center of both sides of the lower surface of the operating member 40, and a pair of actuators 15 are provided near the both ends of the lower surface of the operating member 40. Substantially T shaped shaft supports 41 are integrally formed with the rear surface 11*a* of the operating panel 11 to cross substantially the central portions of respective openings 12. On the upper surface of one leg 41*a* extending in the longitudinal direction of the opening 12 is formed a groove shaped bearing 27 adapted to fit with the shaft 14. Where a plurality of operating members 40 are mounted on a single shaft 14 as in this embodiment, the shaft supports 41 are provided for only the openings on the two ends to support the two ends of the shaft 14, while the central portion of the shaft 14 may be supported by the bottom surface 11*a* of the operating panel 11.

Of course, various embodiments described above may be combined suitably. For example, in the foregoing embodiments, although the operating member is supported by a shaft 14, such shaft may be omitted where the mounting structure is constructed as shown in FIGS. 9*a* and 9*b*, 10*a* and 10*b*.

Figure 9A:
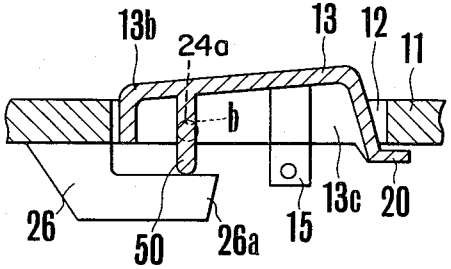
Figure 9B:
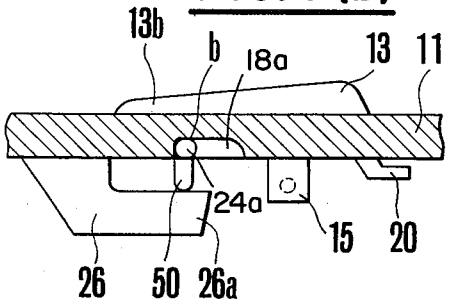

For example, in the construction shown in FIG. 9*a* and 9*b*, like the preceding embodiments, a pair of opposed projections 24*a* and 24*b* (only 24*a* is shown) are provided for both side surfaces of an operating element 13. It is to be noted that, different from the proceding embodiments, these projections are not provided with grooves for bearing but provided with curved portions b on their upper surfaces. In the same manner as the embodiment shown in FIGS. 2 and 3, these curved portions b are received in recesses 18*a* and 18*b* of base plate 11 provided for the outer edges of the opening 12. Further, according to this embodiment, a projection 50 is provided within the trough 13*c* of the operating member 13 adjacent to the rear end 13*b* thereof. The outer end of the projection 50 projects from the side wall or the bottom surface of the operating member 13 to pivotally engage the inner wall of the fore end 26*a* of a supporting member 26 projecting from the rear surface of the panel 11 to overlie an opening 12. The recesses 18*a* and 18*b* (only 18*a* is shown) of the base plate 11 are shaped such that the rear end 13*b* of the operating member 13 can be inserted while sliding between the front end 26*a* of the support 26 and the bottom surface of the base plate 11.

This construction can eliminate the shaft 14 thus decreasing the number of the component parts and moreover as the projection 50 can be integrally formed with the operating member, the number of manufacturing steps can be reduced.

Figure 10A:
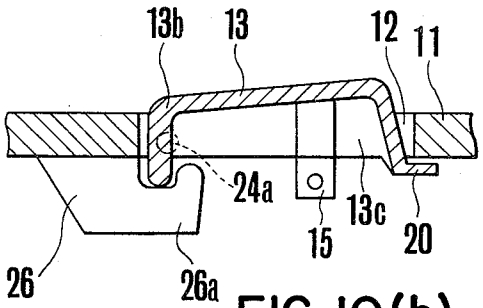
FIGS. 9*a*, 9*b*, 10*a* and 10*b* are side views, partly in section, showing still other embodiments of this invention having simplified constructions.
Figure 10B:
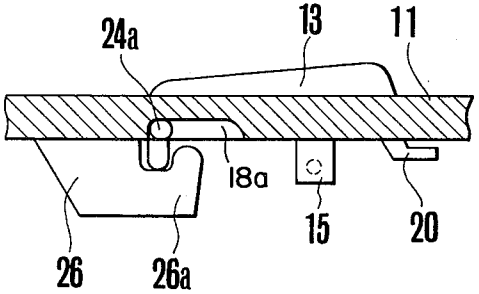

FIGS. 10*a* and 10*b* show simplified constructions of FIG. 9 in which the function of the projection shown in FIG. 9 is provided by the rear wall of the rear end 13*b* of an operating member 13 and a pair of projections 24*a* and 24*b* (only 24*a* is shown) are provided to oppose each other with the rear wall interposed therebetween. These projections 24*a* and 24*b* are adapted to engage the recesses 18*a* and 18*b* (only 18*a* is shown) provided for on the base plate 11. The modified operating members shown in FIG. 10 can be formed with much simpler mold. Of course, in the embodiments shown in FIGS. 9 and 10, the recesses 18*a* and 18*b* of base plate 11 may be omitted or these recesses 28*a* and 28*b* may be formed on the projection of the shaft support 26 in the same manner as in FIG. 6.

What is claimed is:

1. A switch operating mechanism comprising:

a base plate provided with an opening;

an operating member pivotably accommodated in said opening;

a bearing member projecting from a portion of a bottom surface of a base plate near said opening and overlying said opening;

a pair of supporting members with grooves, said supporting members projecting in opposite directions from said operating member, the distance between outer surfaces of said supporting members being larger than the width of said opening;

a shaft member located between said bearing member and said bottom surface of said base plate and across said opening for rotatably engaging said grooves of said supporting members when said operating member is mounted; and an actuator operated by said operating member for actuating a switch mounted on said base plate.

2. A switch operating mechansim according to claim 1 which further comprises a pair of bearing recesses formed on the periphery of said opening and on said bottom surface of said base plate, said bearing recesses receiving said pair of supporting members.

3. A switch operating mechanism according to claim 1 wherein said grooves of said supporting members take the form of a letter U adapted to engage said shaft.

4. A switch operating member according to claim 1 which further comprises a pair of projections disposed on the bottom surface of said base plate for supporting opposite ends of said shaft, said shaft being clamped between said bearing member and said projections.

5. A switch operating mechanism according to claim 1 wherein said shaft is clamped between said base plate and said bearing member.

6. A switch operating mechanism according to claim 1 wherein said bearing member is provided with a bearing in the form of an arcuate or U shaped groove for receiving said shaft.

7. A switch operating mechanism according to claim 1 wherein said switch comprises a two contact driving type seesaw switch.

8. A switch operating mechanism comprising:

a base plate provided with a plurality of juxtaposed openings;

a plurality of operating members pivotably accommodated in said respective openings;

a plurality of bearing members, each projecting from a portion of a bottom surface of a base plate near each of said openings and overlying said respective openings;

a plurality of a pair of supporting members with grooves, said supporting members projecting in opposite directions from each of said operating members, the distance between outer surfaces of said supporting members being larger than the width of said respective openings;

shaft means located between each of said bearing members and said bottom surface of said base plate and across each of said openings for rotatably engaging said grooves of said supporting members when said operating members are mounted; and a plurality of actuators each operated by respective ones of said plurality of operating members for actuating respective ones of a plurality of switches mounted on said base plate.

9. A switch operating mechanism according to claim 8 wherein said shaft is common to said openings, and wherein said grooves of said supporting members take the form of a letter U adapted to engage said shaft.

10. A switch operating mechanism according to claim 8 wherein said each of said switches comprises a two contact driving type seesaw switch.

11. A switch operating mechanism according to claim 8 wherein each of said bearing members comprise a letter T shaped shaft supporting member with one leg extending in the longitudinal directions of said openings for supporting said shaft which is engaged by said supporting members of respective ones of said operating members and said bearing members.

12. A switch operating mechanism comprising:

a base plate provided with an opening;

an operating member pivotably accommodated in said opening;

a bearing member projecting from a portion of a bottom surface of a base plate near said opening and overlying said opening;

a pair of supporting members projecting in opposite directions from said operating member, the distance between outer surfaces of said supporting members being larger than a width of said opening;

an engaging member having a projection extending downwardly from the botton surface of said operating member and located near said opening, said projection rotatably engaging said bearing member when said operating member is mounted; and an actuator operated by said operating member for actuating a switch mounted on said base plate.

13. A switch operating mechanism according to claim 12 wherein said projection is provided by a rear end of said operating member.

* * * * *